US010221544B1

(12) United States Patent
Adams

(10) Patent No.: US 10,221,544 B1
(45) Date of Patent: Mar. 5, 2019

(54) TUB WALL MOUNTED SPOUT

(71) Applicant: Russell Adams, Sugar Hill, GA (US)

(72) Inventor: Russell Adams, Sugar Hill, GA (US)

( * ) Notice: Subject to any disclaimer, the term of this patent is extended or adjusted under 35 U.S.C. 154(b) by 0 days.

(21) Appl. No.: 15/863,355

(22) Filed: Jan. 5, 2018

Related U.S. Application Data

(60) Provisional application No. 62/442,544, filed on Jan. 5, 2017.

(51) Int. Cl.

| | |
|---|---|
| ***A47K 3/00*** | (2006.01) |
| ***E03C 1/04*** | (2006.01) |
| ***A47K 3/02*** | (2006.01) |
| ***E03C 1/042*** | (2006.01) |

(52) U.S. Cl.
CPC ..... *E03C 1/0407* (2013.01); *A47K 3/02* (2013.01); *E03C 1/042* (2013.01)

(58) Field of Classification Search
CPC ..... E03C 1/0407
USPC ..... 4/538, 559, 584
See application file for complete search history.

(56) References Cited

U.S. PATENT DOCUMENTS 8,566,972 B2 * 10/2013 Vogtner ..... A61H 33/60 222/372
2013/0326804 A1 * 12/2013 Autry ..... A47K 3/001 4/559

* cited by examiner

*Primary Examiner* — Lori Baker
(74) *Attorney, Agent, or Firm* — Stephen J. Stark; Miller & Martin PLLC

(57) ABSTRACT

A tub has a wall mounted spout from which mixed hot/cold water flows into the tub below the max fill level of the tub. The spout preferably does not extend significantly into the tub and can be provided with a check valve and/or vent external to the volume of the tub.

12 Claims, 2 Drawing Sheets

TUB WALL MOUNTED SPOUT

CLAIM OF PRIORITY

This application claims the benefit of U.S. Provisional Application No. 62/442,544 filed Jan. 5, 2017, which is incorporated herein by reference in its entirety.

FIELD OF THE INVENTION

The present invention relates to a tub wall mounted spout and more particularly to a spout for use in filling a tub from a hot and cold mixing valve normally mounted at the wall of a tub, a surrounding deck and/or wall proximate to the tub without extending significantly above or into a volume of the tub.

BACKGROUND OF THE INVENTION

Bathtub faucet spouts have not changed significantly in fifty years. They normally extend from a wall surface located either above the tub or in the tub in a direction parallel to the floor of the tub a distance into the body of the tub and then downwardly to then direct water down into the tub. A side cross sectional view would look somewhat like a "J" or "L" shape.

However, with this construction, the faucet spout extends a distance within the volume of the tub which can potentially be an impediment for motion in or otherwise be a cantilevered object subject to potential breakage.

Jetted tubs, such as hot tubs, have been in the marketplace for a number of years. Jets of water are directed from the sides of the tub in such constructions. These systems rely on recirculating water throughout the tub and do not introduce new water into the tub through the jets. The penetrations at the tub sides are not spouts, but instead they are jets.

Accordingly, a need exists to provide an improved filling system for tubs for at least some embodiments for at least some tub configurations.

SUMMARY OF THE INVENTION

It is a present object of many embodiments of the present invention to provide an improved tub filling system.

It is another object of many embodiments of the present invention to provide an improved spout and method of filling a tub with water from the cold and hot water supplies of a residence.

It is a present object of many embodiments of the present invention to provide an improved filling system for a tub with a spout located below a normal full water level of a tub.

It is another object of many embodiments of the present invention to provide a spout located on the wall of a tub in combination with a vent (often installed inside the wall) and cooperates with a system for catching any overflow from the vent inside the wall.

It is also a present object of many embodiments of the present invention to provide a combination of a spout on the wall of a tub in combination with a check valve external to the tub which receives a supply of hot and cold mixed water therethrough with the check valve at least assisting in preventing back flow of water from the tub towards the water supply.

It is another object of many embodiments of the present invention to provide a spout which extends into the tub no more than half an inch from the wall of a tub.

Accordingly, in accordance with a presently preferred embodiment of the present invention, an improved spout construction and method of providing fill water to a tub is provided. Specifically, water can be fed to a tub from hot and cold water supplies normally through a mixing valve as has been done for many years. From the mixing valve water is normally then directed as mixed water through a single conduit towards the tub. However, this is about where the similarities to the prior art end.

As mixed water, or cold or hot water only, is directed toward the tub it may proceed optionally through one of an external vent or an in-wall vent which is preferably configured to be able to vent (and would preferably have a catch which could direct overflow out of the vent to a drain or be held). A vent or a valve vent such as an Acme in-wall valve vent or a Breda valve vent, or other vent, and/or a check valve, such as a Wilkins dual check valve, could assist in preventing at least one or both of back pressure flow as well as back siphonage flow. From the check valve, if utilized, water could then continue to flow through a penetration through a sidewall of the tub which can often be below a full water level of the tub. The penetration could be surrounded by a collar which preferably extends into the tub from the tub wall no more than ½ inch in many embodiments.

This preferred alternative to a traditional faucet can provide a discreet alternative which is not likely to suffer significant abuse internal to the tub volume. Tubs could preferably be stubbed out below the tub with ¾ inch copper pipe (or other tubing), possibly having the check valve installed thereon, possibly together with a vent, so as to be connectable to the mixing valve supplying flow to the tub when provided on location.

Because the collar and wall penetration of the tub is normally below the water level of the tub, prevention of backflow into the fresh water supply is desired for many embodiments. A Wilkins dual check valve has been found satisfactory for many areas of the United States. Other check valves may be satisfactory as well. Alternatively, and/or additionally, an atmospheric vent can be suitable for some construction such as the Acme In-wall vent which is normally installed at least six inches above the height of the tub rim and also provided with a catch there below (which could drain or not so as to be able to catch any spilled water should the atmospheric vent be activated).

Some building codes in the country also require a deck mounted backflow prevention device which could be Breda vent valve which could be installed as a deck mounted backflow prevention device either with or without a check valve and has been found to eliminate at least some of the excess piping normally required for the in-wall type backflow prevention because it can be factory installed on the tub deck to be connected to the mixing valve and potentially overflow into the tub.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
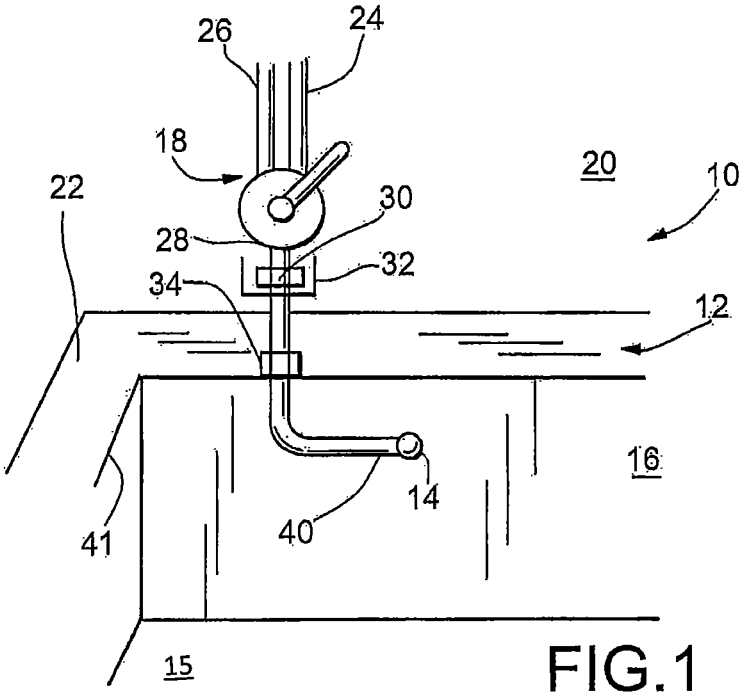
FIG. 1 is a schematic view of the presently preferred embodiment of the present invention.

FIG. 1 shows a schematic of a presently preferred embodiment of the present invention showing a system 10 having a tub 12 with a spout 14 along an upwardly extending wall 16 above a bottom 15 of the tub 12. A mixing valve 18 is located external to the tub for many embodiments. Other embodiments may direct hot and/or cold water directly to sprout(s) 14.

The mixing valve 18 if utilized, could be located along a wall 20, a deck 22 of the tub, a wall 16 of the tub 12 or other locations. Mixing valve 18 receives a cold water supply 24 and a hot water supply 26 and provides a mix of the hot and cold waters 24,26 utilizing the valve 18 to a conduit 28 as would be understood by those ordinarily skilled in the art. Other embodiments may direct cold and/or hot water from supplies 24,26 to separate spouts 14 for other embodiments.

The cold and hot water supplies 24,26 are referred to herein as upstream of the mixing valve 18 while the mixed conduit 28 is referred to as downstream and directed towards the tub 12. Downstream conduit 28 can direct flow to an optional vent 30 preferably disposed above a catch 32 that is explained in further detail below, if utilized. After proceeding through the vent 30, if utilized, the flow can be normally directed through a check valve 34 such as a dual check valve, which will be described in further detail below, and then on out the tub wall mounted spout 14 which can take the form of a collar 36 which preferably does not extend any further into the tub than no more than ½ an inch, if at all. Some collars 36 may be flush with the wall 16 and/or even recessed into the wall 16 for some embodiments.

Figure 2:
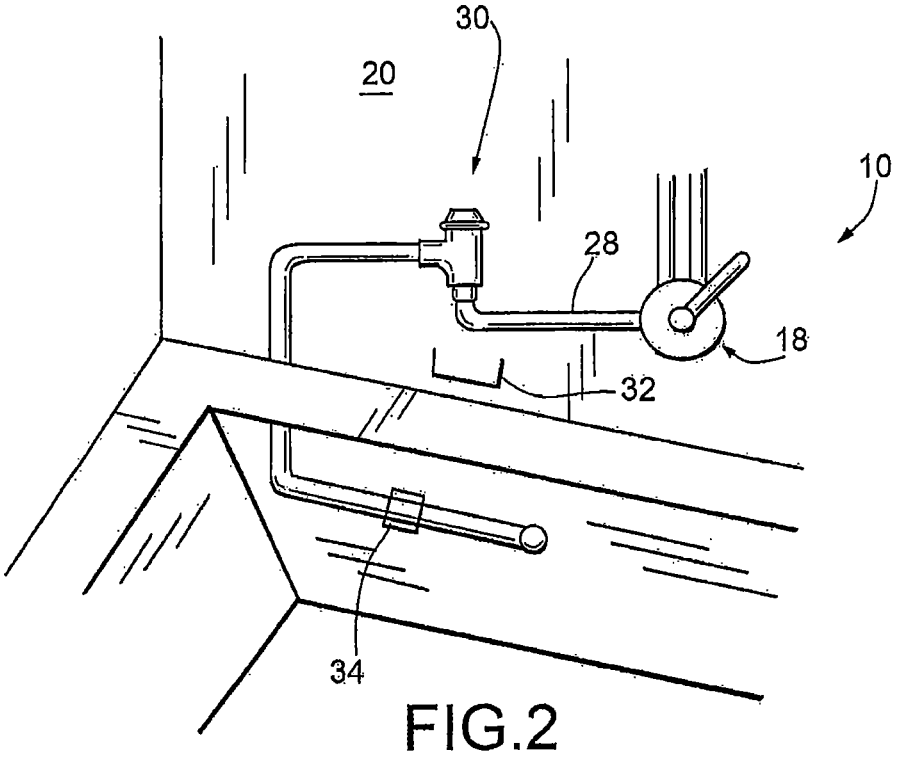
FIG. 2 is a first alternative schematic view showing the construction of FIG. 1 meeting certain building requirements.

FIG. 2 shows the mixing valve mounted on a wall 20 surrounding a portion of tub 12 with the mixed conduit 28 being directed toward a vent 30 which is illustrated as an Acme in-wall vent which may preferably be located six inches above a deck or top rim 22 of a maximum fill of the tub 12. Below the vent 30 is located a catch 32 which could be a drain or other catch designed to catch an overflow to prevent undesired overflow of fluid internal to the wall. The catch 32 may connect to a drain line connected to the tub drain 38 or other drain for at least some embodiments.

Figure 3:
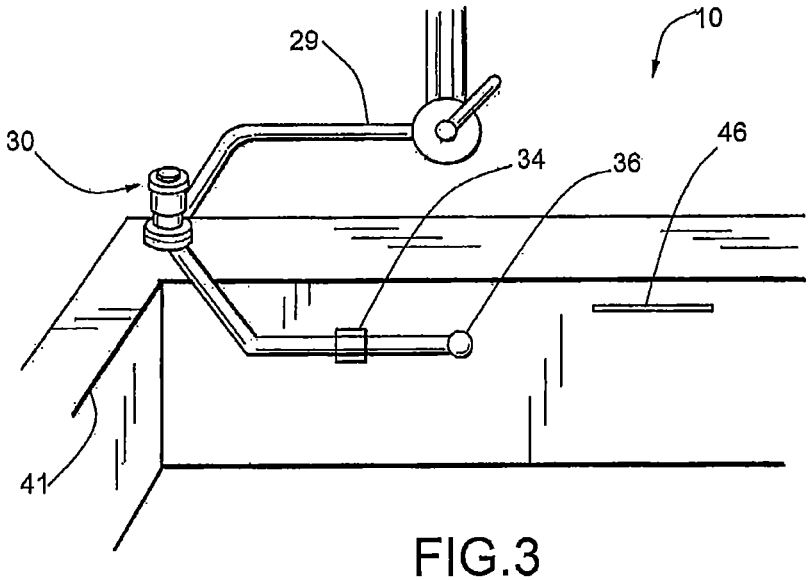
FIG. 3 is a schematic view of the embodiment shown in FIG. 1 meeting other building requirements.

As an alternative as shown in FIG. 3, the conduit 29 may connect to a vent 30 such as a vent valve such as a Breda vent valve illustrated as vent 30 or other type, whether mounted on deck 41 to overflow into tub 12 or other catch. Regardless of which type vent 30 is utilized, if any, the downstream conduit 29 can then continue on past the vent 30 to a check valve 34 such as a Wilkins dual check valve or other check valve to preferably prevent siphonage past the check valve from the water spout 36 upstream towards the vent 30 and or to the mixing valve 18 and back into the supplies 24,26. The check valve 34 can alternatively and/or also prevent back pressure situations which also could create flow in the wrong direction toward the supplies 24,26. Other embodiments may have check valves 34 specified by various billing codes or other so as to prevent backflow into any of the water supplies 24,26.

Figure 4:
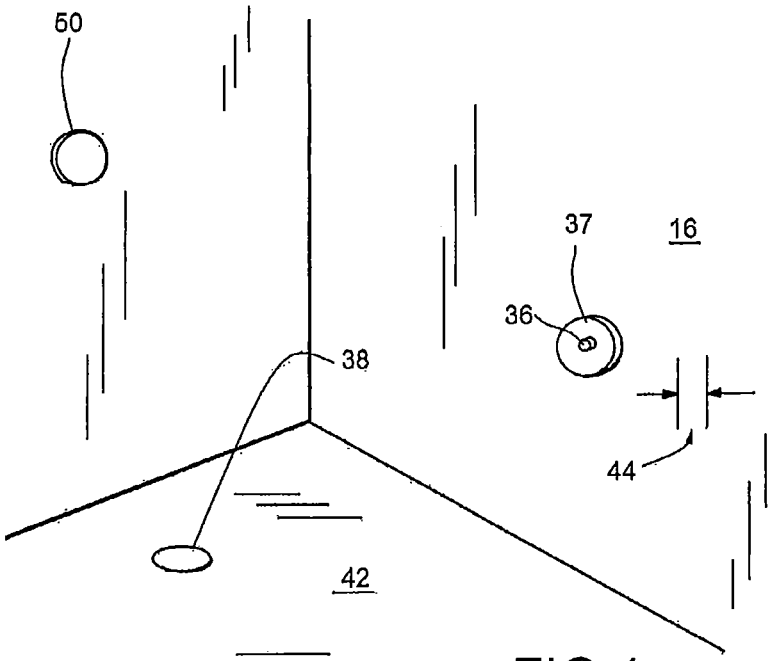
FIG. 4 is an interior perspective view showing filling of a tub with the systems of FIG. 1-3.

The spout 36 preferably provides a perforation or a bore 40 through a side 16 of the tub 12 which may have collar 37 thereabout with neither the collar nor the bore 40 extending into the volume 42 of the tub 12 any more than ½ inch as illustrated by distance 44 in FIG. 4. In fact, some collars may be continuous with the wall 16 and/or either be recessed internal thereto for at least some embodiments. Spout 36 is also located a distance below a normal fill level 46 of a tub.

Some vents 30 could be an atmospheric vent such as an Acme in-wall vent while other could be a Breda valve which can meet backflow prevention codes. Other vents 30 could be utilized as well. Vents 30 are normally above the deck 41 or uppermost waterline with the Acme in-wall vent being at least six inches above the highest normal fill level 46 which could be the deck 41 or rim 22 of the tub or other location for other embodiments. The Breda valve is shown mounted on the rim 22. Overflow port 50 can assist in preventing a situation of overflowing the rim 22 for at least some embodiments.

The present invention provides a method of filling a tub 12 from the tub wall 16 with a spout that extends no more than ½ inch into the volume 42 of the tub 12, and possibly and even likely for some embodiments below a normal fill line 46 where are normally fills the tub. Specifically, water can be mixed with a mixing valve 18 and directed through an optional vent 30 which may have a catch 32 below and then be directed to an optional check valve 34 (as may be required by many jurisdictions) and then through the wall 16 and bore 40 through the wall 16 and the tub such as through collar 36 (if utilized). As the water level increases in the tub 12, it is likely that the water level will eventually pass above the spout 14 while continuing to fill the tub 12. This is not possible in most if not all tubs on the market which have an overflow port below the spout and/or the spout above the rim of the tub so the tub would overflow before the spout were ever contacted. Spout 14 is shown below overflow port 50, which could provide a full water level if the fill water level does not reach a portion of the wall 16 such as at deck 22 or otherwise to overflow, if utilized, for some embodiments as is shown in FIG. 1.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the intention are intended to be included within the scope of the appended claims.

Having thus set forth the nature of the invention, what is claimed herein is:

What is claimed is:

1. A tub having a wall spout comprising:

a tub having a bottom below upwardly extending walls, at least one of terminating at a location providing a full water level above the bottom to define a volume therein with the tub overflowing above the full water level;

a spout extending from the upwardly extending wall, said spout receiving a flow of water therethrough from both a hot and a cold supply mixed and simultaneously directed into the volume through the spout, and controls for filling the tub located external to the volume of the tub; and a vent in communication with the spout, said vent located upstream of the vent and external to the volume of the tub.

2. The tub of claim 1 wherein the vent is one of an in-wall and an external vent.

3. The tub of claim 1 further comprising a check valve intermediate the vent and the spout.

4. The tub of claim 1 further comprising a mixing valve and a check valve, said check valve located intermediate the spout and the mixing valve.

5. The tub of claim 1 further comprising a collar located about the spout against the wall.

6. The tub of claim 1 wherein the upwardly extending walls terminate at a deck which assists in defining the full water level.

7. The tub of claim 6 further comprising a mixing valve and a vent, said vent located intermediate the spout and the mixing valve and connected to the deck of the tub.

8. A tub having a wall spout comprising:

a tub having a deck below upwardly extending walls, at least one of terminating at a location providing a full water level above the bottom to define a volume therein with the tub overflowing above the full water level;

a spout directing water through at least one of the upwardly extending wall and the deck, said spout receiving a flow of water therethrough from both a hot and a cold supply mixed at a mixing valve and then simultaneously directed into the volume with controls for filling the tub located external to the volume of the tub, and a check valve located upstream of spout intermediate the spout and the mixing valve preventing a flow of water from the tub past the check valve; and a vent in communication with the spout, said vent located upstream of the vent and external to the volume of the tub, wherein the upper extending walls terminate at a deck which assist in defining the full water level.

9. The tub of claim 8 wherein the vent is one of an in-wall and an external vent.

10. The tub of claim 8 further comprising a collar located about the spout against the wall.

11. The tub of claim 8 wherein the upwardly extending walls terminate at a deck which assists in defining the full water level, and further comprising a vent.

12. The tub of claim 11 further comprising a vent, said vent located intermediate the spout and the mixing valve and connected to the deck of the tub.

* * * * *